US007858858B2

(12) United States Patent
Eitaki et al.

(10) Patent No.: US 7,858,858 B2
(45) Date of Patent: Dec. 28, 2010

(54) UPRIGHT PIANO

(75) Inventors: Shu Eitaki, Hamamatsu (JP); Tetsuya Okano, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 12/249,381

(22) Filed: Oct. 10, 2008

(65) Prior Publication Data

US 2009/0100980 A1 Apr. 23, 2009

(30) Foreign Application Priority Data

Oct. 11, 2007 (JP) ..... 2007-265867

(51) Int. Cl.
*G10C 3/18* (2006.01)

(52) U.S. Cl. ..... 84/240

(58) Field of Classification Search ..... 84/240, 84/171

See application file for complete search history.

(56) References Cited

U.S. PATENT DOCUMENTS 5,200,570 A 4/1993 Kawamura
5,451,706 A * 9/1995 Yamamoto et al. ..... 84/34
5,539,142 A * 7/1996 Emerson et al. ..... 84/171
2008/0011151 A1* 1/2008 Kato ..... 84/724

FOREIGN PATENT DOCUMENTS

EP 1 837 853 A1 9/2007
JP 2007-079312 3/2007

* cited by examiner

*Primary Examiner*—Jianchun Qin
(74) *Attorney, Agent, or Firm*—Crowell & Moring LLP

(57) ABSTRACT

An upright piano which is capable of providing a soft pedal effect in a first playing mode for performing acoustic playing, and an excellent performance in a second playing mode, without being affected by step-on of a soft pedal, while properly detecting the rotational position of each hammer, is disclosed. The upright piano includes sensors for detecting the rotational position of a hammer in the second playing mode, a hammer rest rail with which the hammer is in contact in a key-off state of a key, a soft pedal, a pedal rod for pushing up the hammer rest rail as the soft pedal is stepped on, a stopper movable between a permitting position and a blocking position, and a stopper drive mechanism for driving the stopper to the permitting position in the first playing mode and to the blocking position in the second playing mode.

5 Claims, 8 Drawing Sheets

UPRIGHT PIANO

FIELD OF THE INVENTION

The present invention relates to an upright piano which is played while switching a plying mode between a first playing mode in which acoustic playing is performed by striking strings with hammers and a second playing mode in which playing is performed while detecting the rotational position of each hammer.

BACKGROUND ART

Conventionally, an upright piano of the above-mentioned type has been disclosed e.g. in Patent Literature 1. This upright piano is a silent piano which is played while switching between a normal playing mode in which playing is performed using acoustic tones and a silent playing mode in which playing is performed using electronic tones. The silent piano includes keys, hammers each of which pivotally moves in accordance with depression of an associated key, a first shutter provided for each key, a first optical sensor disposed below the first shutter, a second shutter provided for each hammer, and second and third optical sensors disposed at a location close to the turning path of the second shutter, and so forth. The first to third sensors are connected to a musical tone generator.

In the silent playing mode, as the hammer pivotally moves in accordance with key depression, the first shutter blocks the optical path of the first optical sensor, and the second shutter blocks the optical paths of the respective second and third optical sensors, whereby detection signals corresponding to the operations of the respective shutters are output from the respective first to third optical sensors to the musical tone generator. The musical tone generator sets sounding timing and a tone volume based on the detection signals from the second and third optical sensors, and sounding stop timing based on the detection signal from the first optical sensor, and generates a musical tone based on these set control parameters.

Further, in general, an upright silent piano is provided with a soft pedal for giving a soft pedal effect in the normal playing mode though it is not described in Patent Literature 1. The soft pedal is connected to a pivotally movable hammer rest rail via a pedal lever and a pedal rod, and in a key-off state of a key, the hammers are held in contact with the hammer rest rail. When the soft pedal is stepped on, the hammer rest rail is pushed up and pivotally moves toward the strings, whereby the position of each hammer in the key-off state (hereinafter referred to as "the key-off position of the hammers") approaches the associated string. As a consequence, the distance between the key-off position of the hammer and the string (hereinafter referred to as "the hammer stroke") becomes shorter, whereby the soft pedal effect can be obtained in the normal playing mode.

In the conventional silent piano constructed as above, when the soft pedal is stepped on in the silent playing mode, the motion of the hammer rest rail caused by the step-on of the soft pedal causes the key-off position of the hammer, i.e. the initial position of the hammer that pivotally moves in accordance with key depression, to approach the string, and hence timing in which the second shutter provided for the hammer blocks the optical paths of the respective second and third optical sensors differs from original blocking timing in a non-stepped-on state of the soft pedal. This makes it impossible to appropriately set sounding timing and a tone volume based on detected blocking timing, and therefore, there is a fear that silent playing cannot be properly performed.

The present invention has been made in order to solve the above problem, and an object thereof is to provide an upright piano which is capable of providing a soft pedal effect by step-on of a soft pedal in a first playing mode for performing acoustic playing, and an excellent performance in a second playing mode even when the soft pedal is stepped on, without being affected by the step-on of the soft pedal, while properly detecting the rotational position of each hammer.

[Patent Literature 1] Japanese Laid-Open Patent Publication (Kokai) No. 2007-79312

DISCLOSURE OF THE INVENTION

Means for Solving the Problem

To attain the above object, the invention as claimed in claim 1 is an upright piano that is played while switching a playing mode between a first playing mode in which acoustic playing is performed by striking a string using a hammer which pivotally moves in accordance with depression of a key, and a second playing mode in which playing is performed while detecting a rotational position of the hammer, characterized by comprising a sensor disposed at a location close to a turning path of the hammer, for detecting a rotational position of the hammer in the second playing mode, a hammer rest rail which is pivotally movable and with which the hammer is in contact in a key-off state of the key, a soft pedal which is stepped on so as to give a soft pedal effect, a pedal rod having a lower end thereof connected to the soft pedal, for being moved upward as the soft pedal is stepped on, to thereby push up the hammer rest rail to cause the hammer to pivotally move toward the string, a spring interposed between the pedal rod and the hammer rest rail, a stopper movable between a permitting position in which the stopper is retreated from the hammer rest rail to permit motion of the hammer rest rail caused by pushing-up of the pedal rod and a blocking position in which the stopper is in abutment with the hammer rest rail to prevent the motion of the hammer rest rail, and a stopper drive mechanism that drives the stopper to the permitting position in the first playing mode and to the blocking position in the second playing mode.

According to this upright piano, the hammer is in contact with the hammer rest rail in the key-off state of the key, and when the key is depressed, the hammer pivotally moves in accordance with the key depression to strike the string. In the first playing mode for performing acoustic playing, the stopper is in the permitting position to be kept retreated from the hammer rest rail by the drive of the stopper drive mechanism. When the soft pedal is stepped on in this state, the pedal rod moves upward in accordance with the step-on of the soft pedal to push up the hammer rest rail via the spring. In this case, since the stopper is in the permitting position, the hammer rest rail pivotally moves toward the string without hindrance by the stopper. This causes the key-off position of the hammer to approach the string, whereby the soft pedal effect is provided.

On the other hand, in the second playing mode, playing is performed while detecting the rotational position of the hammer by the sensor disposed at the location close to the turning path of the hammer.

Further, in the second playing mode, the stopper is in the blocking position by the drive of the stopper drive mechanism and is in abutment with the hammer rest rail. When the soft pedal is stepped on in this state, the pedal rod moves upward to urge the hammer rest rail. However, since the stopper in the blocking position is in abutment with the hammer rest rail, only deformation of the spring interposed between the pedal rod and the hammer rest rail occurs, and the pivotal motion of the hammer rest rail is prevented. As a consequence, the key-off position of the hammer is held in the same position as it is in the non-stepped-on state of the soft pedal, so that the relationship between a key depression stroke of the key and the rotational position of the hammer in the stepped-on state of the soft pedal is held unchanged from that in the non-stepped-on state of the soft pedal. Therefore, even when the soft pedal is stepped on in the second playing mode, it is possible to perform excellent playing, without being affected by the step-on of the soft pedal, while properly detecting the rotational position of the hammer corresponding to the key depression stroke by the sensor.

The invention as claimed in claim 2 is an upright piano as claimed in claim 1, wherein the stopper drive mechanism comprises a switching pedal operated to switch the playing mode between the first playing mode and the second playing mode, and a drive member that operates in accordance with the operation of the switch pedal, to drive the stopper to the permitting position or to the blocking position.

With this construction, the playing mode is switched between the first playing mode and the second playing mode by operating the switching pedal, and the drive member moves in accordance with the operation of the switching pedal to drive the stopper to the permitting position or to the blocking position. Thus, the drive member moves mechanically in accordance with the operation of the switching pedal for switching the playing mode, to drive the stopper to the permitting position or to the blocking position, which makes it possible to reliably and easily drive the stopper for switching the playing mode, without using a sensor or the like The invention as claimed in claim 3 is an upright piano as claimed in claim 1 or 2, wherein the stopper comprises a main stopper part for abutment with the hammer rest rail from above in the blocking position, and a sub-stopper part for abutment with the hammer rest rail from behind in the blocking position.

With this construction, when the stopper is in the blocking position, not only is the main stopper part of the stopper is in abutment with the hammer rest rail from above, but also the sub-stopper part in abutment with the hammer rest rail from behind. Thus, the hammer rest rail is held by the main stopper part and the sub-stopper part from above and behind, respectively, at the same time, which makes it possible to reliably hold the hammer rest rail urged by pressure of the pedal rod from performing pivotal motion.

The invention as claimed in claim 4 is an upright piano as claimed in claim 3, wherein the main stopper part and the sub-stopper part are formed as separate members, and wherein the stopper comprises a vertical adjustment mechanism for adjusting a mounting position of the main stopper part in a vertical direction, and a front-rear adjustment mechanism for adjusting a mounting position of the sub-stopper part in a front-rear direction.

With this construction, the vertical adjustment mechanism adjusts the mounting position of the main stopper part in the vertical direction, and the front-rear adjustment mechanism adjusts the mounting position of the sub-stopper part in the front-rear direction. Therefore, even when the main stopper part and the sub-stopper part deviate from the proper positional relationship with the hammer rest rail due to manufacturing errors or mounting errors of components, it is possible to easily adjust the mounting positions of the main stopper part and the sub-stopper part so as to accommodate the deviation and cause the two stopper parts to be brought into abutment with the hammer rest rail in an optimal state.

The invention as claimed in claim 5 is an upright piano as claimed in any one of claims 1 to 4, wherein the second playing mode is a silent playing mode in which silent playing is performed using an electronic tone based on a musical tone signal generated according to the rotational position of the hammer detected by the sensor.

With this configuration, even when the soft pedal is stepped on in the silent playing mode, it is possible to correctly detect a rotational position of the hammer corresponding to the key depression stroke. This makes it possible to perform excellent silent playing while appropriately setting sounding timing and sounding stop timing for a musical tone and the tone volume of the musical tone according to the detected rotational position.

BEST MODE FOR CARRYING OUT THE INVENTION

Figure 1:
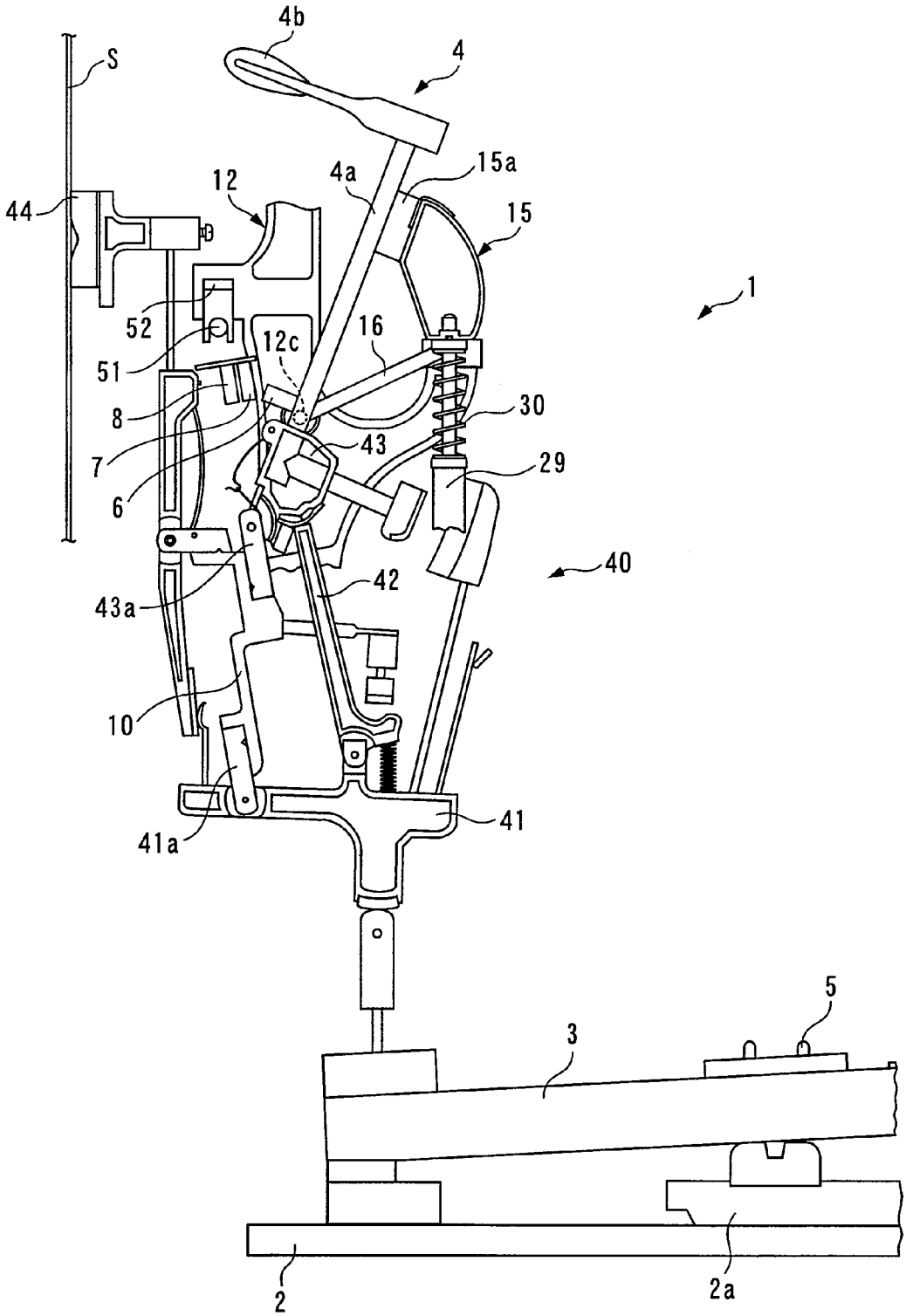
[FIG. 1] A schematic side view of an upright silent piano according to an embodiment of the present invention.

The invention will now be described in detail with reference to the drawings showing a preferred embodiment thereof. FIG. 1 shows an upright silent piano 1 according to a first embodiment of the present invention. It should be noted that in the following description, a player's side of the silent piano 1 as viewed from the player (right side as viewed in FIG. 1) will be referred to as "front", and a remote side from the player (left side as viewed in FIG. 1) as "rear". Further, a left side of the player will be referred to as "left", and a right side of the player as "right".

Figure 2:
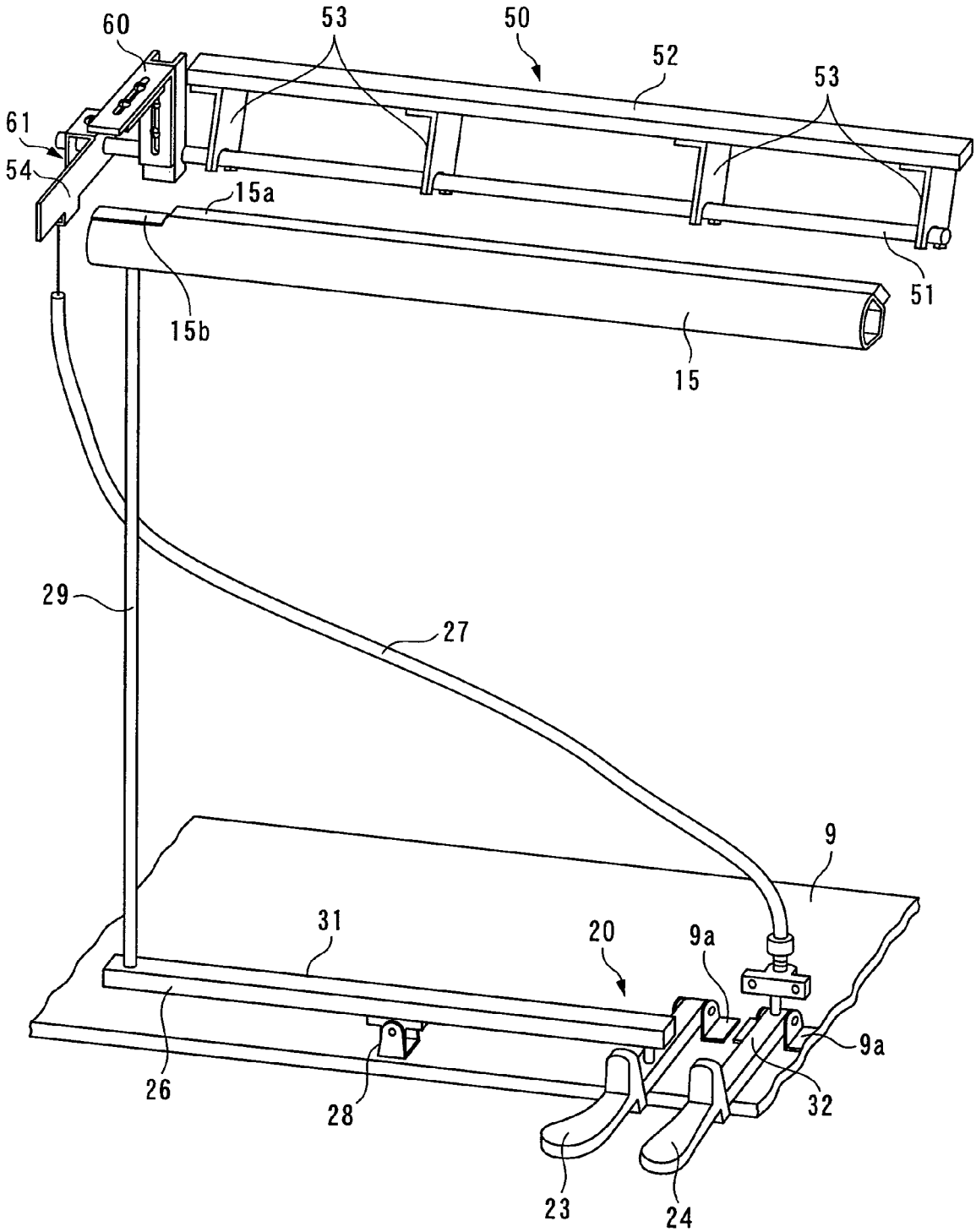
[FIG. 2] A perspective view of a pedal device.

As shown in FIG. 1, the silent piano 1 includes a plurality of (e.g. eighty-eight) keys 3 (only one of which is shown) placed on a keybed 2 in a manner arranged in the left-right direction, actions 40 disposed above the rear parts of the respective keys 3, hammers 4 each provided for an associated one of the keys 3, strings S each stretched at a location rearward of an associated one of the hammers 4, and a pedal device 20 (see FIG. 2). This silent piano 1 is played while switching the playing mode between an acoustic playing mode (first playing mode) in which playing is performed using acoustic tones generated by striking strings S with respective associated hammers 4 and a silent playing mode (second playing mode) in which playing is performed using electronic tones based on musical tone signals generated by a musical tone generating system 17, described hereinafter.

The key 3 is pivotally supported by a balance rail pin 5 erected on a balance rail 2*a* on the keybed 2, via a balance rail pin hole (not shown) formed through a central part of the key 3.

The action 40 is for pivotally moving the hammer 4 in accordance with the key depression and has a wippen 41, a jack 42, and a hammer butt 43 each provided for the associated key 3. The wippen 41 and the hammer butt 43 are pivotally supported, respectively, by a wippen flange 41*a* and a butt flange 43*a* both mounted to a center rail 10. The jack 42 is pivotally mounted to the wippen 41. Further, a damper 44 is pivotally mounted to a rear end of the center rail 10. When the key 3 is released after key depression in a state where a damper pedal 25, described hereinafter, is not operated, the damper 44 comes into contact with the string S to thereby stop sounding.

On the other hand, the hammer 4 includes a hammer shank 4*a* extending upward from the hammer butt 43, and a hammer head 4*b* mounted to an upper end of the hammer shank 4*a*.

As shown in FIG. 2, the pedal device 20 includes a soft pedal 23, a muffler pedal 24, and the damper pedal 25 (see FIG. 3) arranged from left to right in the mentioned order and each extending in the front-rear direction, a pedal lever 26 for the soft pedal 23, a pedal lever (not shown) for the damper pedal 25, and a muffler cable 27, and so forth.

Figure 3:
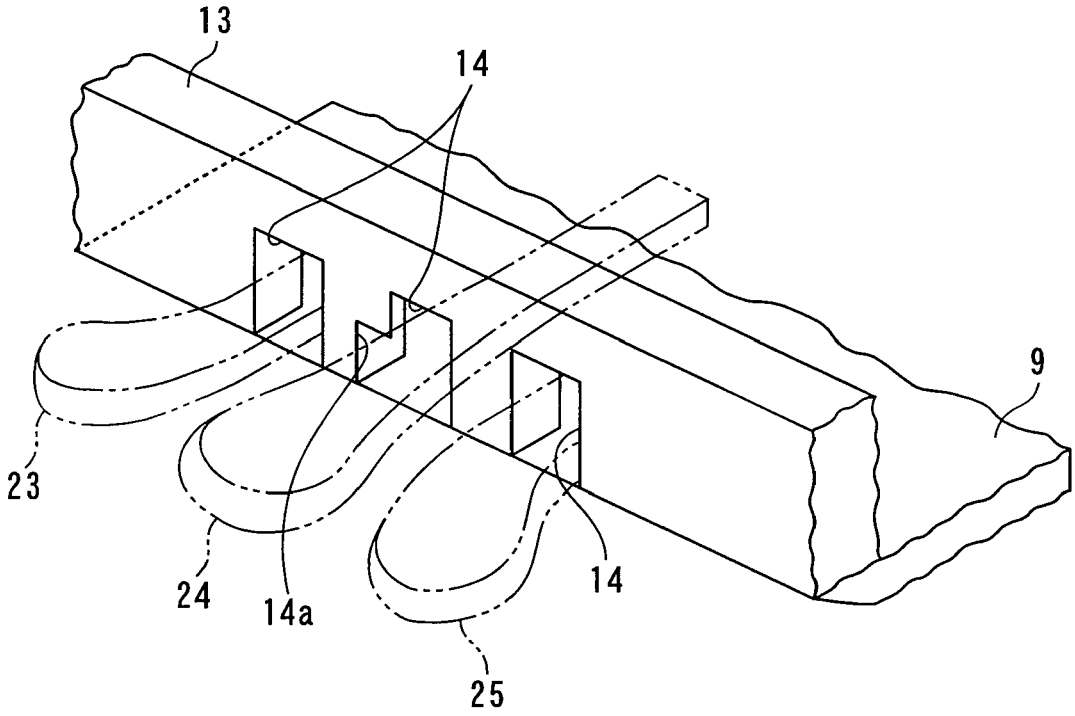
[FIG. 3] An enlarged partial perspective view of the pedal device.

Each of the three pedals 23 to 25 has a rear part thereof mounted on a bottom board 9 via a pedal bracket 9*a* such that the pedal can perform a vertical pivotal motion. The muffler pedal 24 is mounted further in a manner slidable in the left-right direction. As shown in FIG. 3, each of the three pedals 23 to 25 projects forward through a pedal hole 14 formed in a toe rail 13. The pedal holes 14 for the soft pedal 23 and the damper pedal 25 are formed into a rectangular shape. On the other hand, the pedal hole 14 for the muffler pedal 24 has an engaging part 14*a* extending leftward from a lower half of the rectangular part. This construction makes it possible to slide the muffler pedal 24 leftward, after step-on of the same, into engagement with the engaging part 14*a* to thereby hold the muffler pedal 24 in a stepped-on state.

The pedal lever 26 for the soft pedal 23 has its central part supported by a pedal lever bracket 28 such that the pedal lever 26 can swing. The right end of the pedal lever 26 is connected to the soft pedal 23, and the left end thereof is connected to a pedal rod 29.

Figure 4:
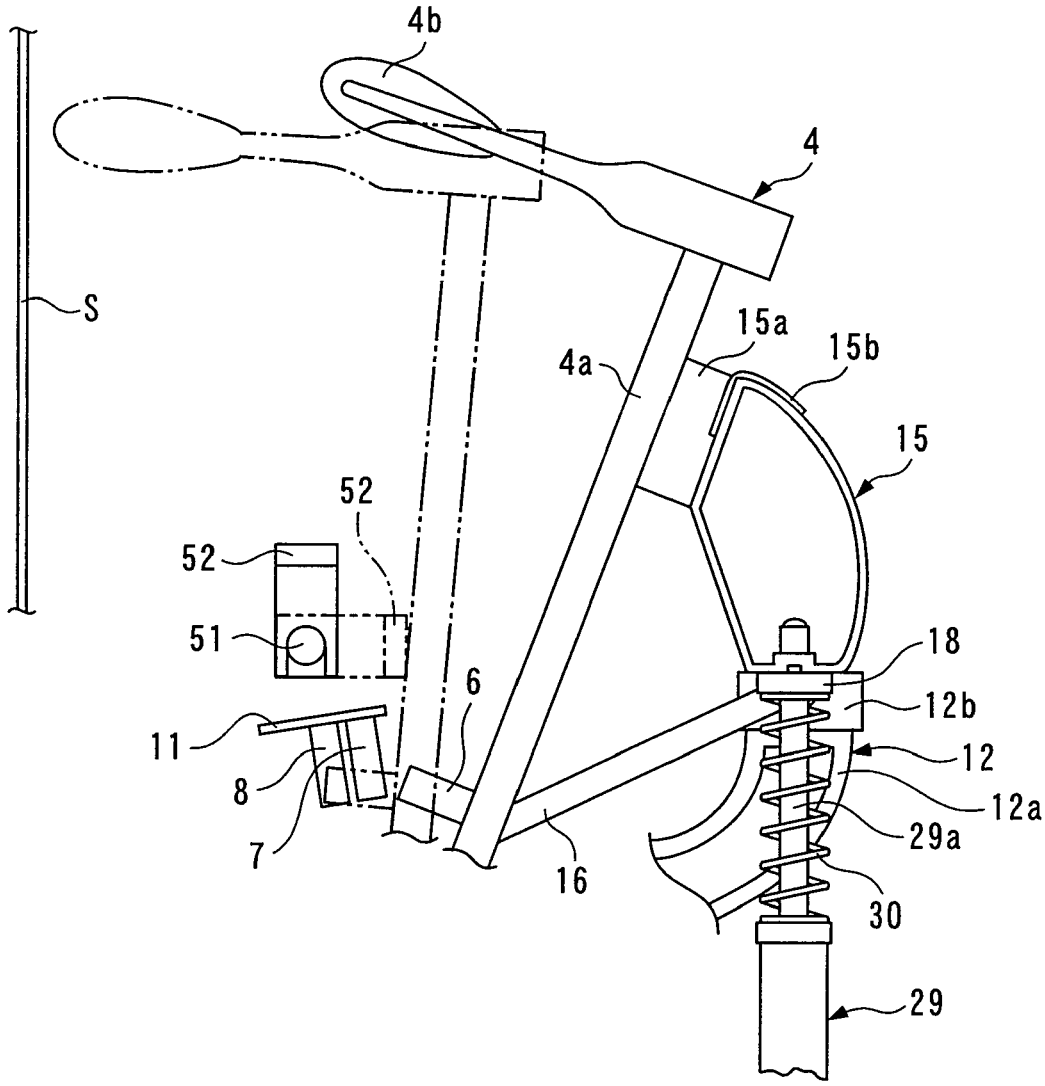
[FIG. 4] A side view useful in explaining operation of a stop rail.

The pedal rod 29 is formed by a round bar, and extends upward from the pedal lever 26 to a location close to the left end of a hammer rest rail 15. As shown in FIG. 4, the upper end of the pedal rod 29 is formed as a spring mounting part 29*a* smaller in diameter than the other part of the pedal rod 29. The spring mounting part 29*a* extends through a hole formed in a bottom wall of the hollow hammer rest rail 15 and projects into the hollow inside of the hollow hammer rest rail 15. Further, a coil spring 30 having a predetermined spring force and a predetermined length is mounted on the spring mounting part 29*a* in a manner held in contact from below with a spring receiving part 18 provided on the bottom wall of the hammer rest rail 15.

The hammer rest rail 15 is formed by an extrusion molded article made e.g. of an aluminum alloy, and extends in the left-right direction between brackets 12 (only one of which is shown) mounted on the respective left and right ends of the keybed 2 (see FIG. 2). As shown in FIGS. 1 and 4, the hammer rest rail 15 has a hollow sector shape in cross section, and a shock absorbing member 15*a* formed e.g. of felt is affixed to the rear surface of the hammer rest rail 15 except a left end of the same.

Front ends of respective arms 16 (only one of which is shown) are fixed to the respective left and right end of the hammer rest rail 15 with screws, and the rear end of each of the arms 16 is engaged with an engaging hole 12*c* formed in the bracket 12. Thus, the hammer rest rail 15 is supported by the bracket 12 via the arms 16 in a manner pivotally movable about a horizontal axis.

With the above-described construction, in a state where the soft pedal 23 is not stepped on, the hammer rest rail 15 is held in a stop position (indicated by solid lines in FIG. 7) and placed on a rail placing part 12*a* of the bracket 12 via a shock absorbing member 12*b*. Further, in a key-off state, the hammer shank 4*a* of the hammer 4 is in an inclined position in abutment with the hammer rest rail 15 via the shock absorbing member 15*a*, and hence the key-off position of the hammer 4 is determined according to the position of the hammer rest rail 15.

On the other hand, when the soft pedal 23 is stepped on, a portion of the pedal lever 26 rightward of the pedal lever bracket 28 is pulled down, and a left portion of the pedal lever 26 pivotally moves upward, whereby the pedal rod 29 moves upward to push up the hammer rest rail 15 via the coil spring 30. As a consequence, the hammer rest rail 15 pivotally moves rearward from the stop position through a predetermined angle to an operated position (indicated by two-dot chain lines in FIG. 7), and the key-off position of the hammer 4 also moves toward the string S in accordance with the motion of the hammer rest rail 15 (see a position indicated by two-dot chain lines in FIG. 7).

The muffler pedal 24 is stepped on to switch the playing mode between the acoustic playing mode and the silent playing mode. The muffler pedal 24 is connected to a muffler 50 via the muffler cable 27. As shown in FIG. 2, the muffler 50 is comprised of a drive rod 51, a stop rail 52 for stopping the pivotal motion of the hammer 4, four connecting members 53 for connecting between the drive rod 51 and the stop rail 52, and a drive lever 54 for driving the drive rod 51.

The drive rod 51 is formed by a round bar. The drive rod 51 extends along the whole length of the action 40 in the left-right direction at a location rearward of the bracket 12, and is pivotally supported by the bracket 12 via a support metal fitting 12*d* (see FIG. 7) fixed to the bracket 12. Further, the drive lever 54 is fixed to the drive rod 51 and is connected to the muffler cable 27.

Each of the connecting members 53 extends in the vertical direction, with a lower end thereof fixed to the drive rod 51 and an upper end thereof fixed to the stop rail 52. The stop rail 52 extends in the left-right direction along the whole length of the array of all the hammers 4.

With the above-described arrangement, in a state where the muffler pedal 24 is not stepped on, the stop rail 52 is held in a retreated position (indicated by solid lines in FIG. 4) where the stop rail 52 is retreated from the range of pivotal motion of the hammer shank 4*a* of the hammer 4. On the other hand, when the muffler pedal 24 is stepped on, as the muffler cable 27 is pulled down, the drive lever 54 and the drive rod 51 integral with the drive lever 54 pivotally move through a predetermined angle in a clockwise direction as viewed in FIG. 4, whereby the stop rail 52 pivotally moves to an advanced position (indicated by two-dot chain lines in FIG. 4) within the range of pivotal motion of the hammer shank 4*a*.

Figure 5:
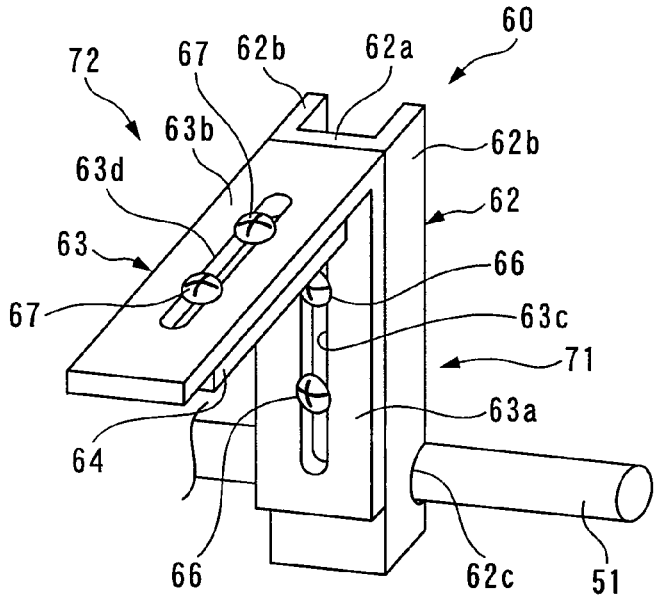
[FIG. 5] A perspective view of a stopper of a hammer rest rail.
Figure 6:
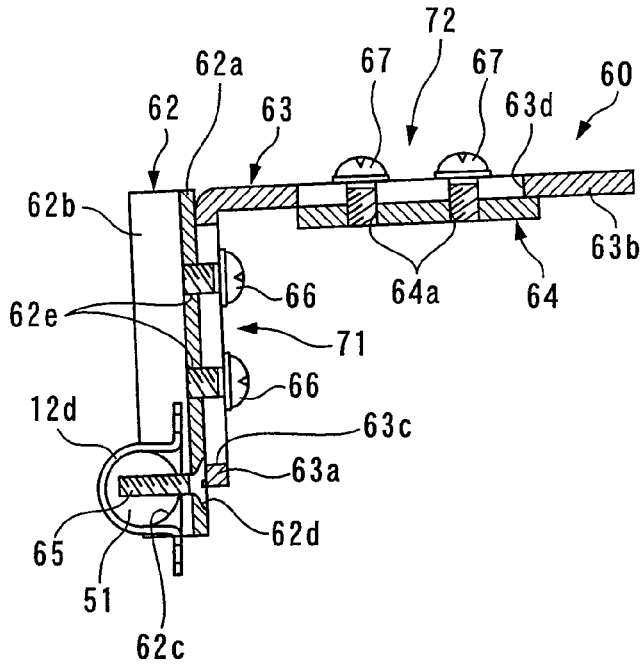
[FIG. 6] A cross-sectional view of the stopper.

As shown in FIG. 2, a stopper 60 is provided in the vicinity of the left end of the hammer rest rail 15. The stopper 60 is configured to prevent the hammer rest rail 15 from being moved by push-up of the pedal rod 29 in the silent playing mode. As shown in FIGS. 5 and 6, the stopper is comprised of a base part 62, a main stopper 63, and a sub-stopper 64. These parts are each formed e.g. by a bent steel plate, and have the same width.

The base part 62 has a front wall 62*a* and left and right side walls 62*b* and 62*b* forming a U shape open rearward, and extends vertically. The side walls 62*b* and 62*b* have lower portions thereof formed with semicircular cutouts 62*c* and 62*c* (only one of which is shown), respectively, such that the semicircular cutouts 62*c* and 62*c* are opposed to each other. The base part 62 is fixed to the drive rod 51 by screwing a countersunk screw 65 into the drive rod 51 via the front wall 62*a* with the cutouts 62*c* and 62*c* fitted on a circumferentially half of part of the drive rod 51. The head of the countersunk screw 65 is accommodated in a counterbored hole 62*d* formed in the front wall 62*a* so as not to hinder mounting of the main stopper 63 to the front wall 62*a*.

The main stopper 63 has an L shape in cross section, and is comprised of a mounting part 63*a* mounted on the front wall 62*a* of the base part 62, and a contact part 63*b* extending forward from the upper end of the mounting part 63*a* to a location over the hammer rest rail 15 or its vicinity. The mounting part 63*a* is formed with a slot 63*c* extending in the vertical direction, and the contact part 63*b* is formed with a slot 63*d* extending in the front-rear direction. The main stopper 63 is fixed to the base part 62 by screwing two screws 66 and 66 passed through the slot 63*c* into respective two upper and lower screw holes 62*e* and 62*e* formed in the front wall 62*a*.

With the above-described construction, by sliding the main stopper 63 vertically on the front wall 62*a* along the slot 63*c* before screwing the screws 66, it is possible to continuously adjust the mounting position of the main stopper 63 vertically. That is, in the present embodiment, the slot 63*c* of the main stopper 63, the two screw holes 62*e* and 62*e* of the base part 62, and the screws 66 and 66 constitute a vertical adjustment mechanism 71.

The sub-stopper 64 is a flat-plate member attached on the lower surface of the contact part 63*b* of the main stopper 63. Specifically, the sub-stopper 64 is fixed to the main stopper 63 by screwing two screws 67 and 67 passed through the slot 63*d* of the contact part 63*b* into respective two front and rear screw holes 64*a* and 64*a* formed in the sub-stopper 64.

With the above-described construction, by sliding the sub-stopper 64 on the contact part 63*b* in the front-rear direction along the slot 63*d* before screwing the screws 67, it is possible to continuously adjust the mounting position of the sub-stopper 64 in the front-rear direction. That is, in the present embodiment, the slot 63*d* of the main stopper 63, the two screw holes 64*a* and 64*a* of the sub-stopper 64, and the screws 67 and 67 constitute a front-rear adjustment mechanism 72.

Further, a shock absorbing member 15*b* formed of e.g. a thin sheet-like felt is affixed to a portion of the hammer rest rail 15 corresponding to the stopper 60 (see FIGS. 1 and 4).

Figure 7:
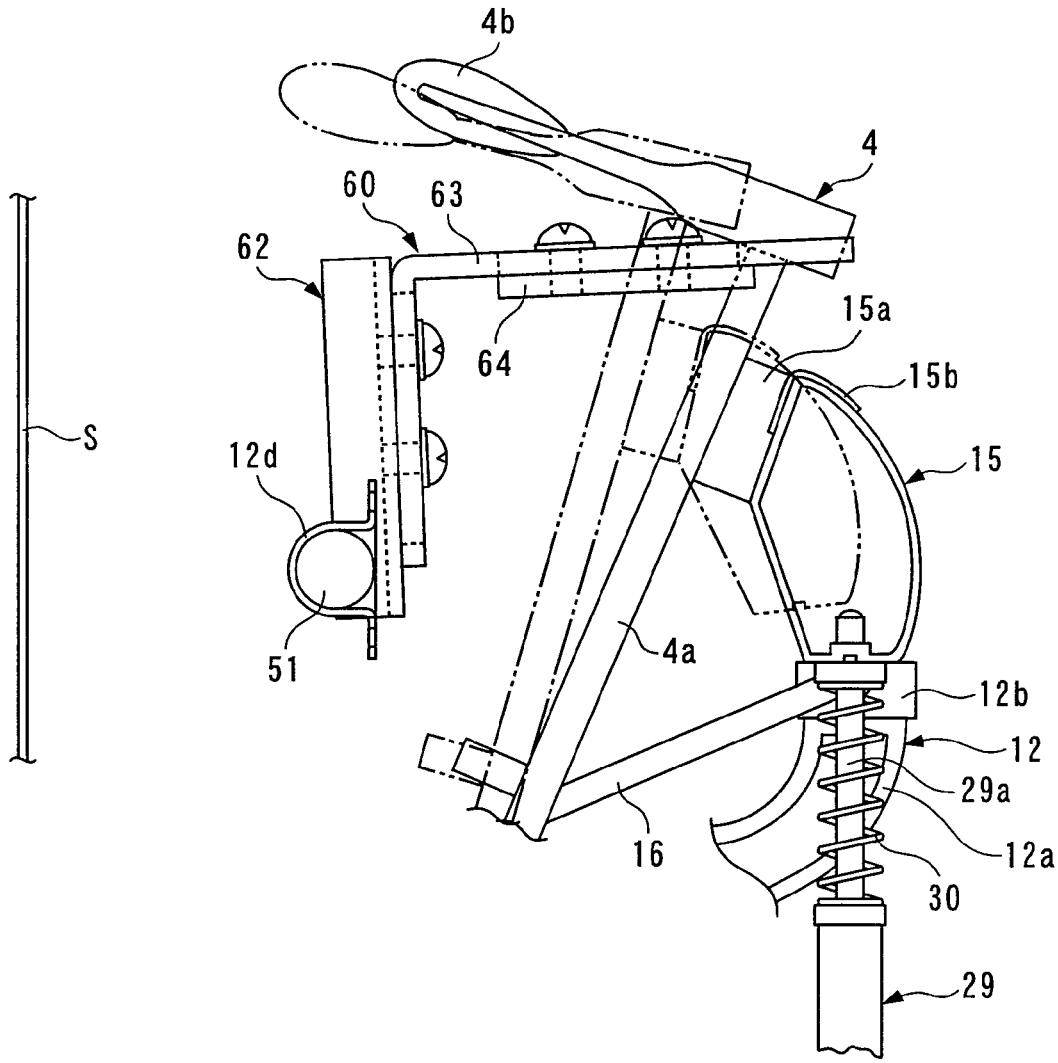
[FIG. 7] A side view useful in explaining an operation in a state where the stopper is held in a permitting position.

With the above-described construction, in a state where the muffler pedal 24 is not stepped on, the stopper 60 is held in a permitting position appearing in FIG. 7. In this permitting position, the contact part 63*b* of the main stopper 63 and the sub-stopper 64 are retreated to a location far above the hammer rest rail 15. As a consequence, when the soft pedal 23 is stepped on, the hammer rest rail 15 is permitted to be moved by the push-up of the pedal rod 19, and moves to the operated position indicated by the two-dot chain lines.

Figure 8:
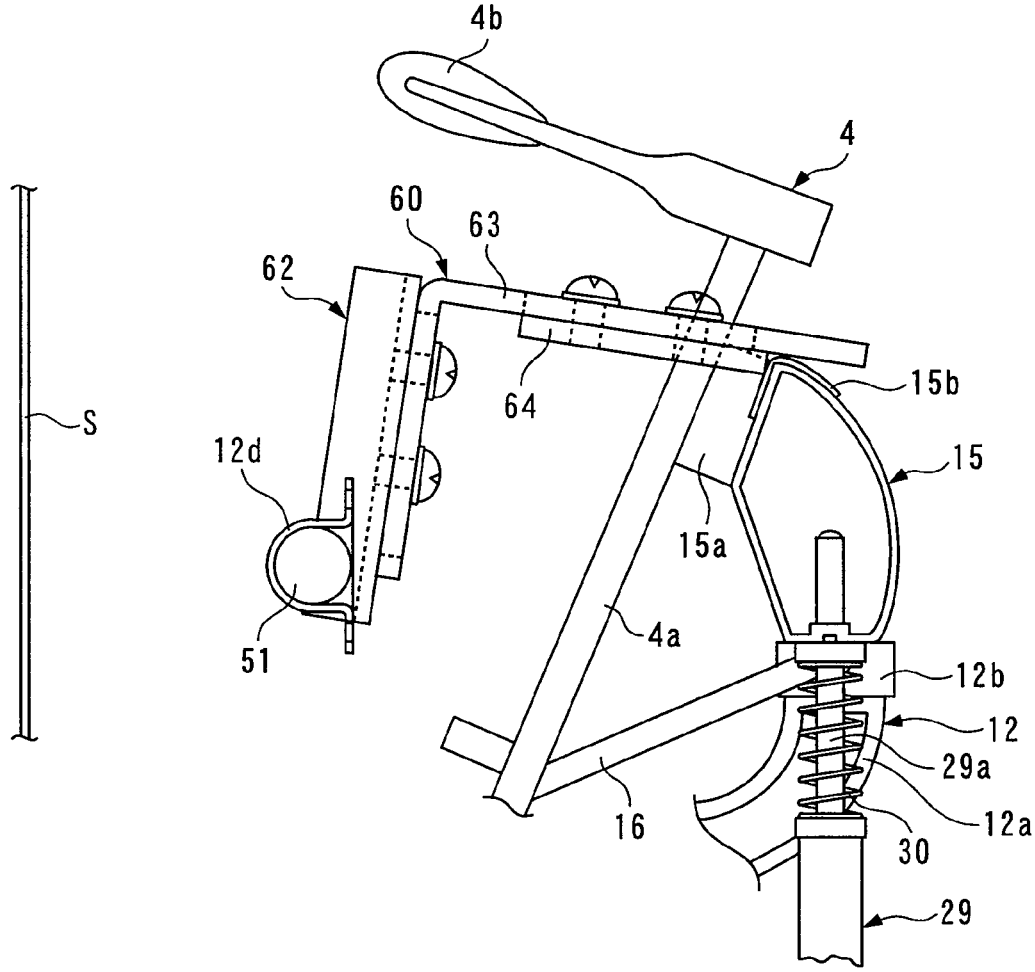
[FIG. 8] A side view useful in explaining an operation in a state where the stopper is held in a blocking position.

On the other hand, when the muffler pedal 24 is stepped on, as the drive rod 51 is pivotally moved by the muffler cable 27 and the drive lever 54, the stopper 60 integral with the drive rod 51 pivotally moves from the permitting position through the predetermined angle in the clockwise direction, whereby the stopper 60 moves to a blocking position shown in FIG. 8. In this blocking position, the contact part 63*b* of the main stopper 63 and the front end of the sub-stopper 64 come into abutment with the hammer rest rail 15, from above and from behind, respectively, via the shock absorbing member 15*b* at respective portions of the hammer rest rail 15 close to its top part as a boundary between its front and rear surfaces. This blocks the motion of the hammer rest rail 15 caused by the push-up of the pedal rod 29 when the soft pedal 23 is stepped on, whereby the hammer rest rail 15 is held in the stop position.

As described above, when the muffler pedal 24 is stepped on, the stopper 60 is driven by the muffler cable 27, the drive lever 54, and the drive rod 51. That is, in the present embodiment, the four elements 24, 27, 54, and 51 constitute a stopper drive mechanism 61.

Figure 9:
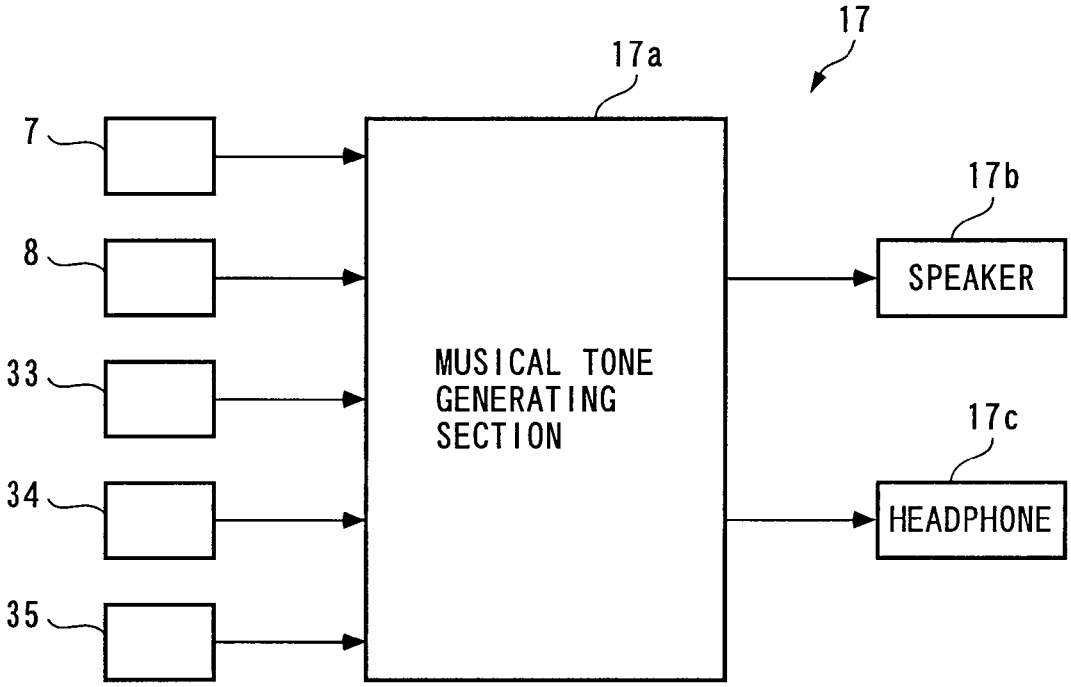
[FIG. 9] A block diagram of a musical tone generating system.

Further, a soft pedal switch 33 is provided in the vicinity of the pedal lever 26, and a muffler pedal switch 34 is provided in the vicinity of the muffler pedal 24 (see FIG. 9). The switches 33 and 34 are implemented e.g. by microswitches, and output to the musical tone generating system 17 ON/OFF signals corresponding to whether or not the soft pedal 23 and the muffler pedal 24 have been stepped on, respectively. Further, the damper pedal 25 is provided with a damper pedal sensor 35 (see FIG. 9). The damper pedal sensor 35 outputs a detection signal indicative of a stepped-on amount of the damper pedal 25 to the musical tone generating system 17.

The musical tone generating system 17 is configured to generate electronic musical tones in the silent playing mode, and is comprised of a shutter 6 and first and second optical sensors 7 and 8 for detecting key depression information on each key 3, a musical tone generating section 17*a*, a speaker 17*b*, and a headphone 17*c*.

As shown in FIG. 4, the shutter 6 is formed into a rectangular plate shape, and is fixed to the rear surface of the hammer shank 4*a* of the hammer 4 in a manner extending rearward. The first and second optical sensors 7 and 8 are disposed at respective predetermined locations rearward of the shutter 6.

Each of the first and second optical sensors 7 and 8 is implemented by a pair of a light emitting diode and a phototransistor (neither of which is shown), and is electrically connected to a printed circuit board 11. The first and second optical sensors 7 and 8 are arranged in parallel in the front-rear direction along a turning path of the shutter 6. When the optical paths of the respective optical sensors 7 and 8 are blocked by the shutter 6, the optical sensors 7 and 8 output respective signals of L level as detection signals to the musical tone generating section 17*a*, whereas when the optical paths are open, the optical sensors 7 and 8 output respective signals of H level as the detection signals to the musical tone generating section 17*a*. The printed circuit board 11 is mounted on a mounting rail (not shown) extending between the left and right brackets 12 and 12.

When the ON signal is being output from the muffler pedal switch 34, i.e. when the muffler pedal 24 is currently stepped on, the musical tone generating section 17*a* generates a musical tone signal according to the detection signals from the respective first and second optical sensors 7 and 8. Specifically, sounding timing, sounding stop timing, and a tone volume are determined according to the detection signals from the respective first and second optical sensors 7 and 8, and then a musical tone is generated based on the results of the determination, followed by being output to the speaker 17*b* or the headphone 17*c*. It should be noted that the musical tone is output to the headphone 17*c* when a jack (not shown) of the headphone 17*c* is plugged in.

Further, when the ON signal is being output from the soft pedal switch 33, the musical tone generating section 17*a* reduces the level of a tone signal to thereby give a soft pedal effect to an electronic tone. Furthermore, the musical tone generating section 17*a* adds a predetermined reverberation effect to a musical tone signal according to the detection signal from the damper pedal sensor 35 to thereby give a damper pedal effect to an electronic tone.

Next, a description will be given of the operation of the silent piano 1 constructed as described above. In the case of carrying out acoustic playing, the muffler pedal 24 is held in a non-stepped-on state. As described hereinbefore, when the muffler pedal 24 is in the non-stepped-on state, the stop rail 52 is held in the retreated position (indicated by the solid lines in FIG. 4), and the stopper 60 is held in the permitting position (see the position in FIG. 7). As the key 3 is depressed in this state, the jack 42 moves upward along with the wippen 41 pivotally moving in accordance with the key depression, to push up the hammer butt 43, whereby the hammer 4 pivotally moves counterclockwise as viewed in FIG. 1. In this case, since the stop rail 52 is held in the retreated position, the hammer 4 pivotally moves without hindrance by the stop rail 52, and the hammer head 4*b* strikes the string S, whereby acoustic playing is performed.

When the soft pedal 23 is stepped on during this acoustic playing, the pedal rod 29 is driven via the pedal lever 26 to move upward, whereby the hammer rest rail 15 is pushed up via the coil spring 30. In this case, since the stopper 60 is held in the permitting position, the hammer rest rail 15 pivotally moves counterclockwise as viewed in FIG. 7, without hindrance by the stopper 60, from the stop position (indicated by the solid lines) to the operated position (indicated by the two-dot chain lines). In accordance with this, the hammer 4 as well pivotally moves toward the string S, and the key-off position of the hammer 4 approaches the string S, whereby the soft pedal effect can be obtained.

On the other hand, in the case of carrying out silent playing, the muffler pedal 24 is stepped on to be brought into engagement with the engaging part 14*a*. When the muffler pedal 24 is thus stepped on, the stop rail 52 is moved to the advanced position (indicated by the two-dot chain lines in FIG. 4) by the operation described hereinbefore, and the stopper 60 is moved to the blocking position (see the position in FIG. 8). As the key 3 is depressed in this state, the hammer shank 4*a* of the pivotally moving hammer 4 comes into contact with the stop rail 52 in the advanced position, whereby further pivotal motion of the hammer 4 is prevented so as to prevent the hammer 4 from striking the string S. Further, an electronic tone corresponding to a rotational position of the hammer 4 detected by the first and second optical sensors 7 and 8 is generated by the musical tone generating section 17*a* and output from the speaker 17*b* or the headphone 17*c*.

When the soft pedal 23 is stepped on during this silent playing, the pedal rod 29 moves upward, as shown in FIG. 8, to urge the hammer rest rail 15. However, since the stopper 60 in the blocking position is held in abutment with the hammer rest rail 15, the coil spring 30 is compressed, but the hammer rest rail 15 is held in the stop position without being pivotally moved. As a consequence, the key-off position of the hammer 4 is also held in the same position as it is in the non-stepped-on state of the soft pedal 23, so that the relationship between the key depression stroke of the key 3 and the rotational position of the hammer 4 in the stepped-on state of the soft pedal 23 is held unchanged from that in the non-stepped-on state of the soft pedal 23. Therefore, even when the soft pedal 23 is stepped on during silent playing, it is possible to perform excellent silent playing, without being affected by the step-on of the soft pedal 23, while properly detecting the rotational position of the hammer 4 corresponding to the key depression stroke of the key 3 by the first and second optical sensors 7 and 8.

Further, since the stopper 60 is mechanically driven by the stopper drive mechanism 61 in accordance with the operation of the muffler pedal 24 for switching the playing mode, it is possible to reliably and easily drive the stopper 60 for switching the playing mode, without using a sensor or the like. Furthermore, the component elements of the stopper drive mechanism 61, i.e. the muffler pedal 24, the muffler cable 27, the drive lever 54, and the drive rod 51 are also used as a drive mechanism for the stop rail 52 that switches the playing mode, and the shared use of the component elements contributes to reduction of the number of components and manufacturing costs.

When the stopper 60 is in the blocking position, the main stopper 63 and the sub-stopper 64 are held in abutment with the hammer rest rail 15, from above and from behind, respectively, at the same time, so that it is possible to reliably hold the hammer rest rail 15 urged by pressure of the pedal rod 29 from performing pivotal motion. Further, since the main stopper 63 and the sub-stopper 64 are screwed via the respective slots 63*c* and 63*d*, it is possible to perform continuous adjustment of the main stopper 63 in the vertical direction and continuous adjustment of the sub-stopper 64 in the front-rear direction, independently of each other. Therefore, even when the main stopper 63 and the sub-stopper 64 deviate from the proper positional relationship with the hammer rest rail 15 due to manufacturing errors or mounting errors of components, it is possible to easily adjust the mounting positions of the respective two stoppers 63 and 64 so as to accommodate the deviation and cause the stoppers 63 and 64 to be brought into abutment with the hammer rest rail 15 in an optimal state.

It should be noted that the present invention is by no means limited to the above-described embodiment, but can be practiced in various forms. For example, although in the present embodiment, the stopper drive mechanism 61 for driving the stopper 60 is formed by the muffler pedal 24, the drive rod 51, and so forth, and is shared for use as the drive mechanism for the stop rail 52, the construction may be arbitrarily modified insofar as the stopper 60 can be properly driven in accordance with switching of the playing mode.

Further, although in the present embodiment, the stopper 60 has the main stopper 63 and the sub-stopper 64 formed as separate members, they may be formed as one piece. Alternatively, it is also within the scope of the present invention that the stopper is more simplified such that it comes into abutment with the hammer rest rail 15 only from above or from behind. Further, it is a matter of course that the slots and the screws used to form the vertical adjustment mechanism and the front-rear adjustment mechanism for adjusting the mounting position of the stopper 60 in the vertical direction and in the front-rear direction, respectively, can be replaced by other suitable means. Further, although the coil spring is used as a spring interposed between the hammer rest rail and the pedal rod, another kind of spring, such as a leaf spring, may be employed.

Moreover, although in the above-described embodiment, the present invention is applied to a silent piano by way of example, this is not limitative, but the present invention can be applied to an automatic playing piano. In this case, even when the soft pedal is stepped on during recording of performance data, the key-off position of the hammer can be held in the same position as it is in the non-stepped-on state of the soft pedal, and therefore it is possible to obtain appropriate performance data according to a detected rotational position of the hammer. It is to be further understood that various changes and modifications may be made without departing from the spirit and scope thereof.

The invention claimed is:

1. An upright piano that is played while switching a playing mode between a first playing mode in which acoustic playing is performed by striking a string using a hammer which pivotally moves in accordance with depression of a key, and a second playing mode in which playing is performed while detecting a rotational position of the hammer, comprising:

a sensor disposed at a location close to a turning path of the hammer, for detecting a rotational position of the hammer in the second playing mode;

a hammer rest rail which is pivotally movable and with which the hammer is in contact in a key-off state of the key;

a soft pedal which is stepped on so as to give a soft pedal effect;

a pedal rod having a lower end thereof connected to said soft pedal, for being moved upward as said soft pedal is stepped on, to thereby push up said hammer rest rail to cause said hammer rest rail to pivotally move toward the string;

a spring interposed between said pedal rod and said hammer rest rail;

a stopper which is disposed above a top of the hammer rest rail and which is engageable with the hammer rest rail, wherein the stopper is movable between a permitting position in which said stopper is retreated from said hammer rest rail to permit motion of said hammer rest rail caused by pushing-up of said pedal rod and a blocking position in which said stopper is in abutment with said hammer rest rail to prevent the motion of said hammer rest rail caused by the pushing-up of said pedal rod so that the position of the hammer in the key-off state of the key is held in the same position as it is in the non-stepped-on state of the soft pedal; and a stopper drive mechanism that drives said stopper to the permitting position in the first playing mode and to the blocking position in the second playing mode.

2. An upright piano as claimed in claim 1, wherein said stopper drive mechanism comprises:

a switching pedal operated to switch the playing mode between the first playing mode and the second playing mode, and a drive member that operates in accordance with the operation of said switch pedal, to drive said stopper to the permitting position or to the blocking position.

3. An upright piano as claimed in claim 1 or 2, wherein said stopper comprises:

a main stopper part for abutment with said hammer rest rail from above in the blocking position, and a sub-stopper part for abutment with said hammer rest rail from behind in the blocking position.

4. An upright piano as claimed in claim 3, wherein said main stopper part and said sub-stopper part are formed as separate members, and wherein said stopper comprises:

a vertical adjustment mechanism for adjusting a mounting position of said main stopper part in a vertical direction, and a front-rear adjustment mechanism for adjusting a mounting position of said sub-stopper part in a front-rear direction.

5. An upright piano as claimed in claim 1, wherein the second playing mode is a silent playing mode in which silent playing is performed using an electronic tone based on a musical tone signal generated according to the rotational position of said hammer detected by said sensor.

* * * * *